US006079124A

United States Patent [19]

Dalvy

[11] Patent Number: 6,079,124

[45] Date of Patent: Jun. 27, 2000

[54] LINER WITH A COMPOSITE UPPER

[75] Inventor: Olivier Dalvy, Saint Felix, France

[73] Assignee: Salmon S.A., Metz-Tessy, France

[21] Appl. No.: 09/249,792

[22] Filed: Feb. 16, 1999

[30] Foreign Application Priority Data

Feb. 17, 1998 [FR] France ..... 98 02243

[51] Int. Cl.[7] ..... A43B 23/07; A43B 7/14

[52] U.S. Cl. ..... 36/10; 36/55; 36/88

[58] Field of Search ..... 36/55, 10, 88, 36/89

[56] References Cited

U.S. PATENT DOCUMENTS

| | | | |
|---|---|---|---|
| 3,003,154 | 10/1961 | Litman | 36/55 |
| 3,858,337 | 1/1975 | Vogel | 36/55 |
| 4,523,392 | 6/1985 | Gabrielli | 36/10 |
| 4,662,087 | 5/1987 | Beuch | 36/88 |
| 4,744,157 | 5/1988 | Dubner | 36/88 |
| 5,067,257 | 11/1991 | Coomer | 36/93 |
| 5,211,672 | 5/1993 | Andujar | 36/106 |
| 5,339,545 | 8/1994 | Paris | 36/55 X |
| 5,430,960 | 7/1995 | Richardson | 36/88 X |
| 5,575,015 | 11/1996 | Paris et al. | 36/10 X |
| 5,802,742 | 9/1998 | Baude et al. | 36/117.6 |

FOREIGN PATENT DOCUMENTS

| | | |
|---|---|---|
| 0086909 | 8/1983 | European Pat. Off. . |
| 0623295 | 11/1994 | European Pat. Off. . |
| 0674856 | 10/1995 | European Pat. Off. . |
| 2722662 | 1/1996 | France . |
| 7831331 | 2/1979 | Germany . |
| WO 96/07339 | 3/1996 | WIPO . |

*Primary Examiner*—Ted Kavanaugh
*Attorney, Agent, or Firm*—Greenblum & Berstein, P.L.C.

[57] ABSTRACT

A liner having a single foot entry for a rigid shell sport boot, constituted of an upper enveloping the foot and the malleoli and of a top portion of the upper that covers the user's lower leg. The top portion of its upper has a composite structure formed of a plurality of comfort elements coupled together and fixed to a relatively thin support envelope that extends on the exterior, and each comfort element is made from a material having a specific density and degree of firmness that are different from those of the element to which it is coupled. The differentiation of the characteristics of the elements with respect to one another allows transmitting the impulses from the user's lower leg to the boot shell in preferred predetermined directions in correspondence with selected support zones on the lower leg.

7 Claims, 3 Drawing Sheets

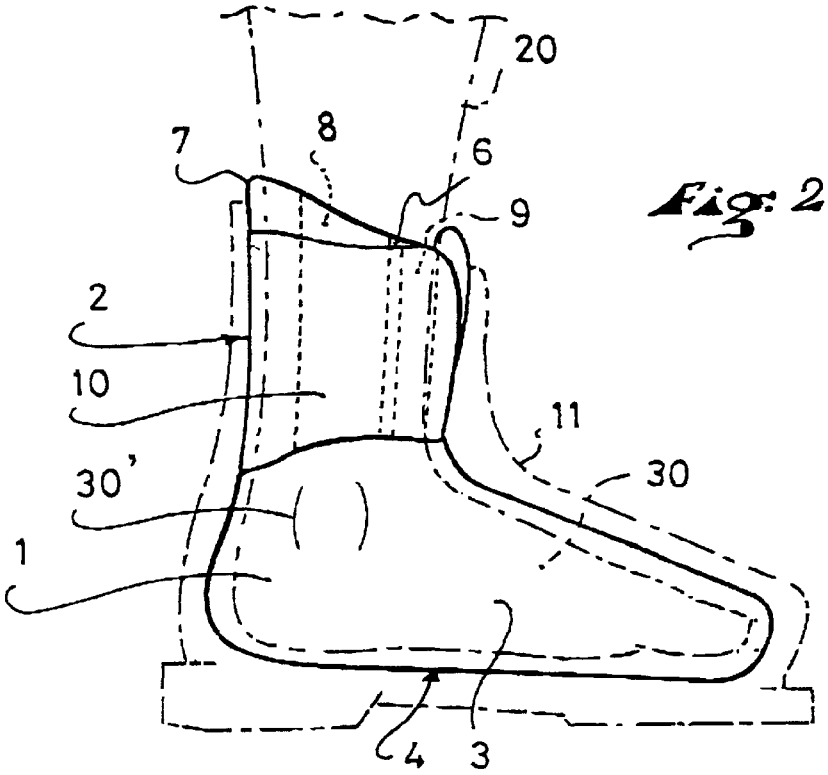
Fig. 2
Fig. 3
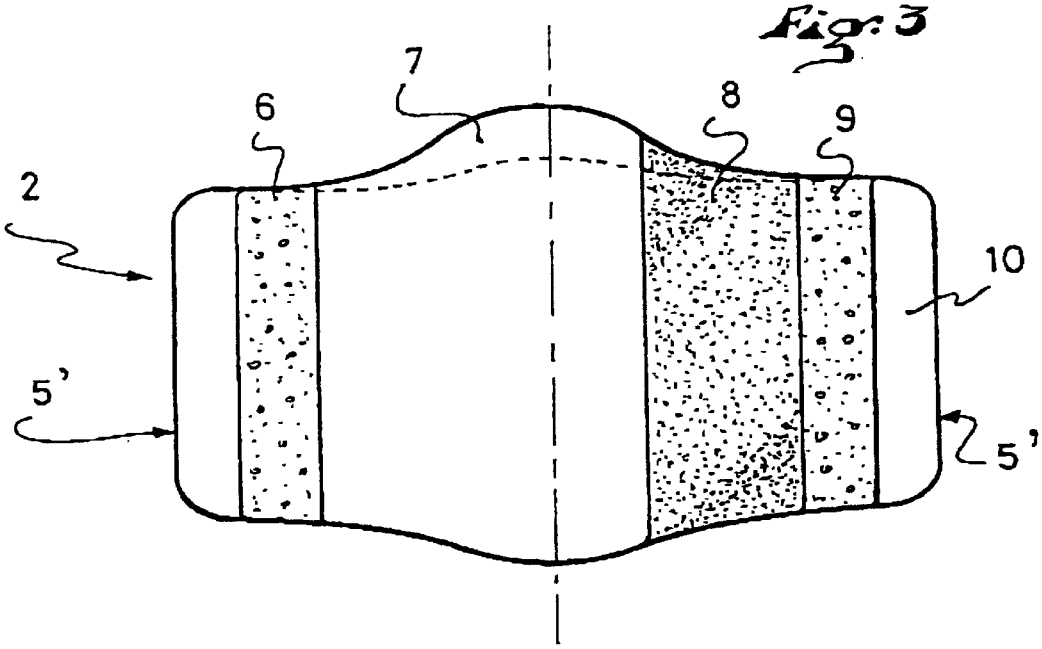

7
8
9
2'
10
5'
21
5'
25
3
4

LINER WITH A COMPOSITE UPPER

BACKGROUND OF THE INVENTION

1. Field of the Invention

The present invention relates to an inner liner for a sport boot of the rigid shell type and to a liner, the top portion of the upper of which has a composite structure adapted to transmit the impulses from the user's lower leg towards the rigid shell, and vice-versa, in predetermined directions.

2. Description of Background and Relevant Information

Boots provided with inner liners of the aforementioned type are known particularly from European Patent Application No. 0 674 856 and French Patent Publication No. 2 722 662.

In the example of EP 0 674 856, a liner having a single foot entry is described for a ski boot, roller skate, or ice skate, and is provided on its upper with a reinforcement element that is attached and fixed to the exterior of its comfort wall. This reinforcement element extends along the upper edge of the top portion of the liner upper which covers the area of the heel and of the malleoli. A removable T-shaped piece, engaged under the reinforcement element and against the comfort wall of the liner, on which it is vertically adjustable, ensures the wedging of the malleoli and strengthens the upper edge of the top portion of the liner upper in its dorsal area due to a rigid extension with which it is provided and which extends above the upper edge. Because of these arrangements, the top portion of the liner upper has a composite structure formed of several layers, one of which at least provides an additional support to the user's lower leg so as to transmit the latter's impulses towards the rigid shell of the boot, and vice versa, in predetermined directions, oriented in the front-to-rear direction and partially lateral due to the reinforcement element and the rigid T-shaped piece.

Such a liner is found to be comfortable since the user's lower leg and foot are essentially in contact with the comfort wall of the liner upper which, presented as a single piece, plays the role of adjusting the fitting properties and of an interface together and the rigid shell via the reinforcement element with its T-shaped wedging piece.

Conversely, due to the fact that the reinforcement element is exterior to the comfort wall of the liner, the latter has the drawback of not providing a means capable of transmitting the impulses of the lower leg towards the rigid shell with a different intensity and/or speed in one or several predetermined particular directions. Indeed, due to the fact that it must systematically pass through the comfort wall to transmit the impulses, the user perceives the sensations and supports in a delayed and relatively vague manner since they are widely distributed in every direction through the comfort wall. Late and inaccurate reactions result from the user that do not allow optimizing the transmission of the impulses and the accurate control of the sport apparatuses, skis or skates, for example, that are attached to the boot. Further, in this liner, the rigid wedging piece is susceptible of being accidentally displaced between the reinforcement and the comfort wall, and therefore of modifying the user's lower leg supports on the top portion of the liner upper and the boot.

In the example of document FR 2 722 662, this type of drawback is solved but mainly for the transmission of forces and impulses oriented in lateral directions between the user's lower leg and the rigid shell of the boot and, in the context of a particular composite structure of the top portion of the upper having two foot entries, the one, anterior, for the front fitting and the other, posterior, for the rear fitting. More specifically, the top portion of the liner upper is formed of a front portion and a rear portion which are separated by two lateral openings where stiffening plates are extended which are at least partially covered by the openings.

Such a liner is found to be, on the one hand, very easy to put on due to the fact that the front and rear portions of the top portion of its upper are free to tilt frontwardly and rearwardly and, on the other hand, relatively efficient for transmitting the impulses to the boot in laterally oriented directions.

However, it has the drawback of penalizing the continuity of the wrapping of the top portion of its upper around the user's lower leg and, as a result, the comfort. Additionally, the front and rear portions, which are supposedly more comfortable than the stiffening plates, are susceptible of coming into contact with the foot and leg only at the extreme anterior and posterior zones of the latter since the portions cover the edges of tile plates. Moreover, these stiffening plates, which by definition are rigid, cover the malleolar region of tile fool where the relatively projecting articular apophyses must be particularly protected, in terms of the comfort and the adjustment to the foot morphology, which is in itself incompatible with the rigidity of these plates.

Finally, since the top portion of the upper of this type of liner is constituted of several components that are merely juxtaposed and formed of front and rear portions which are free with respect to the stiffening plates that they surround at least partially, it is relatively difficult to achieve the imperviousness of the liner upper.

SUMMARY OF THE INVENTION

An object of the present invention is lo overcome the previously mentioned drawbacks by proposing a liner having a single foot entry which is both comfortable and efficient, and capable, in particular, of transmitting the impulses from the user's lower leg directly to the boot shell, and vice versa, with more or less intensity and speed in predetermined directions, and in correspondence with selected support zones on the user's lower leg.

One object of the invention is to provide a liner whose upper's top portion, at least, has a composite structure which extends continuously on both sides of the foot entry and which is stable, i.e., not subject to accidental changes in the position of the supports and/or the wedging that it provides for the user's lower leg. The invention also proposes a liner whose tightening and/or adjustment on the lower leg is facilitated due to the arrangement of the composite structure that is partially fixed behind the edges of the opening for the foot entry in the top portion of the upper.

Another object is to modulate the density-firmness of the comfort wall of the top portion of the liner upper depending on the relative position of the support zones of the user's lower leg, which are selected so as to provide a transmission of impulses that is different in intensity and speed with respect to the other non-selected zones of the lower leg.

To achieve these objects, the liner having a single foot entry for a rigid shell sport boot is constituted of an upper enveloping the foot and a top portion of an upper covering the user's lower leg. The top portion of its upper has a composite structure formed of several comfort elements coupled together and fixed to a relatively thin support envelope that extends on the outer side of the liner, and in that each comfort element is obtained from a material having a specific density and degree of firmness that are different from those of the element and/or elements to which it is coupled.

In this manner, the top portion of the liner upper is capable of transmitting the impulses from the user's lower leg to the rigid boot shell, and vice versa, with more or less intensity and speed directly related to the density and firmness of the biased comfort element. Additionally, due to the fact that the comfort elements are coupled together and fixed to a support envelope, the top portion of the liner upper has a wall that extends continuously up to the area of the foot entry, giving it a certain homogeneity and improving the imperviousness.

According to another characteristic, each comfort element of the top portion of the liner upper is positioned in correspondence with a selected support zone on the user's lower leg, depending on the directional effects to be produced on the rigid shell of the boot, and thus on the sport apparatus to which it is attached. Indeed, due to the fact that the density and degree of firmness of each comfort element are determining factors for the intensity and speed of the transmission of forces and biases that are applied to it, as well as for producing a certain shock absorption, the selective positioning of the different comfort elements on the top portion of the liner upper allows orienting this transmission towards the boot shell in one or several preferred directions.

According to a construction detail, the liner upper enveloping the user's foot and malleoli is preferably made of a comfort material that is adjusted to the morphology of these enveloped parts, whereas the top portion of the upper, having a composite structure, is extended above these parts. Thus, the relatively projecting apophyses of the malleoli are relatively protected.

According to a preferred embodiment, the comfort elements of the top portion of the liner upper are generally elongated and are arranged side by side while being oriented in the vertical direction.

BRIEF DESCRIPTION OF DRAWINGS

The invention will be better understood through the following description, with reference to the attached schematic drawings showing, by way of example, an embodiment in which:

FIG. 2 shows, in a side view, the liner in FIG. 1 inserted into the shell of a boot schematically shown according to its contour;

FIG. 3 shows a developed view of the top portion of the liner upper in FIGS. 1 and 2.

DETAILED DESCRIPTION OF THE INVENTION

Figure 1:
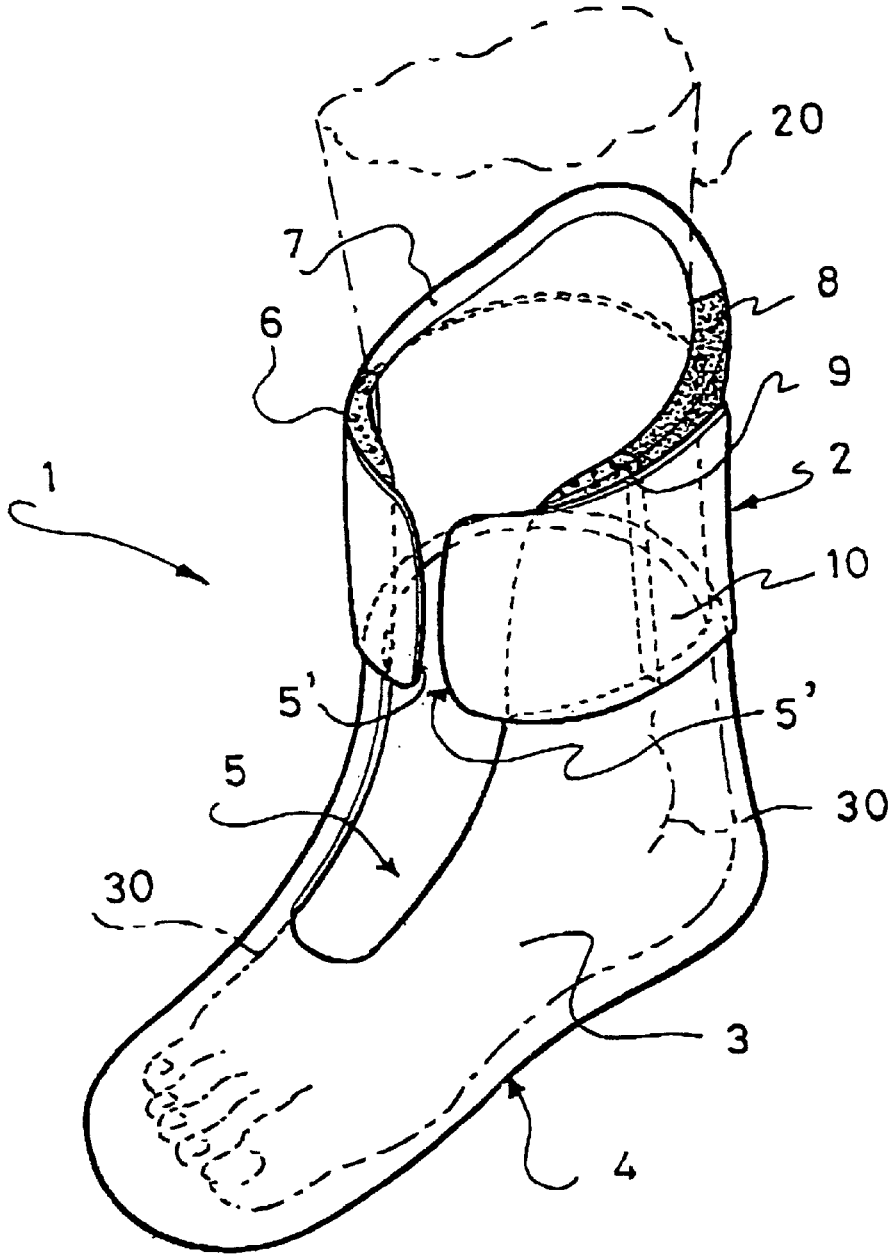
FIG. 1 shows, in a perspective view, an inner liner with a front foot entry having a top portion of an upper according to the invention.

The liner 1, shown in FIGS. 1 and 2, is adapted to be inserted into a "rigid" type shell 11 of a boot whose contour is shown schematically in FIG. 2. This liner 1 has a sole 4 on which an upper 3 is mounted that is extended by a top portion 2 of the upper, all of which envelop the user's foot 30 and lower leg 20, respectively. A longitudinal opening 5, opening out towards the top portion 2 of the upper, is made in the anterior zone of the liner 1 and constitutes the foot entry.

According to one characteristic, the top portion 2 of the upper has a composite structure formed of several comfort elements 6, 7, 8 and 9, or four in this construction example, which are coupled together and fixed to a relatively thin support envelope 10 that extends on the exterior of the liner 1.

This support envelope 10 can be either rigid or flexible since its function is merely to ensure the support and assembly of the different comfort elements 6, 7, 8 and 9, such that the top portion 2 of the upper has a configuration that is relatively homogenous with a continuously extending wall.

According to another characteristic, each comfort element 6, 7, 8 and 9 is obtained from a material having a specific density and degree of firmness that are different from those of the element or elements to which it is coupled so as to provide the user's lower leg 20 with a firm support and/or a certain shock absorption in the area where the comfort element is positioned. In fact, the variations in density and firmness from one comfort element to another allow the direct accentuation or minimi7ation of the transmission intensity and speed of the impulses produced by the user from certain support zones of his lower leg 20 to the rigid shell 11 of the boot 1, especially without having to use one or more reinforcement elements inserted into the thickness of the wall of the top portion 2 of the upper, or fixed to the exterior of the top portion as known in the prior art.

Consequently, each comfort element 6, 7, 8, and 9 of the top portion 2 of the upper is judiciously positioned in correspondence with a selected support zone on the user's lower leg 20, depending on the directional effects to be produced on the rigid shell 11 of the boot. Thus, if a directional effect on the internal flank of the rigid shell 11 of the boot is sought, it is a dense and firm comfort element 8 that is positioned on the top portion 2 of the upper across from the internal lateral zone of the user's lower leg 20, whereas a distinctly softer and thinner comfort element 7 is used to ensure the envelopment of the posterior and lateral zones of the lower leg where no particular directional effect is sought; this is also the case for the comfort elements 6 and 9 that merely ensure the attachment to the edges 5' of the opening 5 for the foot entry.

Each element 6, 7, 8, and 9 can have a particular envelopment surface that is more or less large and possibly preformed or deformable.

According to an embodiment of the comfort elements 6, 7, 8, and 9, their constitutive material is a polyurethane foam whose density is modulated depending on the desired firmness of the comfort element 6, 7, 8, or 9 considered.

Preferably, the upper 3 of the liner 1 enveloping the user's foot 30 and malleoli 30' can be made of a material capable of being easily deformed so as to adjust itself to the morphology of these parts 30, 30' without creating a hard spot or an exaggerated pressure, since the impulses and biases intervening between the lower leg 20 and the rigid shell 11 of the boot almost all occur again at the level of the top portion 2 of the upper that extends right above these parts 30, 30', i.e., above the upper 3.

Advantageously, the comfort elements 6, 7, 8, and 9 of the top portion 2 of the upper are made in an elongated shape and are arranged side by side while being oriented in the vertical direction of the Lop portion 2 of the upper, as shown in FIG. 3.

According to a construction detail, the comfort elements 6 and 9, that ensure the attachment of the other comfort elements 7 and 8 to the edges 5' of the opening 5 for the foot entry, are fixed behind the edges 5' that demarcate the support envelope 10 in the transverse direction of the top portion 2 of the upper. This arrangement promotes the sliding of the edges 5' with respect to one another or with the element (not shown) that covers the foot entry 5 and which is normally constituted by a tongue. Consequently, the tightening of the top portion 2 of the upper on the user's lower leg is eased.

Figure 4:
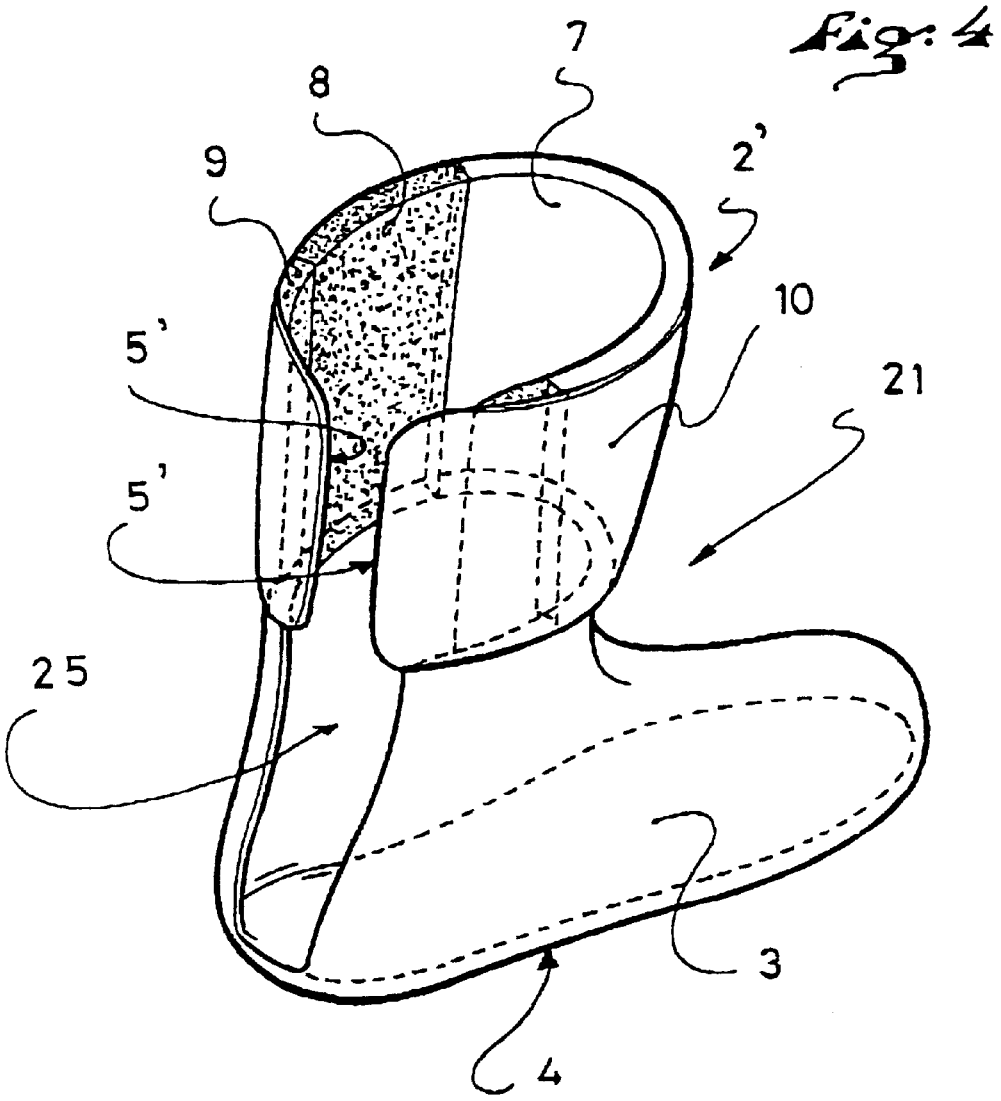
FIG. 4 shows, in a perspective view, an inner liner with a rear foot entry having a top portion of an upper of the same type as that of the liner in FIGS. 1–3.

The invention is not limited to a liner whose foot entry is located at the front. Thus, as shown in FIG. 4, the liner 21 has an opening 25 for a rear foot entry and is made with a top portion 2' of an upper of the same type as the top portion 2 that was previously described with reference to FIGS. 1–3. Therefore, this top portion 2' of the upper whose components have the same numerical references will not be described again.

The comfort elements 6, 7, 8, and 9 can be made from any type of materials, have various shapes and come in variable numbers depending on the comfort and supports sought on the user's lower leg 20 to induce predetermined directional effects on the rigid shell 11 of the boot.

The instant application is based upon the French priority patent application No. 98 02243, filed Feb. 17, 1998, the disclosure of which is hereby incorporated by reference thereto in its entirety, and the priority of which is hereby claimed under 35 USC 119.

What is claimed is:

1. A liner having a single foot entry for a rigid shell sport boot, said liner comprising:

an upper for enveloping the foot and the malleoli, said upper including a top portion for covering the user's lower leg, said top portion having a composite structure formed of a plurality of comfort elements coupled together and fixed to a relatively thin support envelope that extends on an exterior of the liner, wherein the top portion of the liner is made with a vertical opening for entry of the user's foot, and wherein each comfort element of the top portion of the liner upper is obtained from a material having a specific density and degree of firmness that is different from that of the element to which it is coupled.

2. A liner according to claim 1, wherein each comfort element of the top portion of the liner upper is positioned in correspondence with a selected support zone on the user's lower leg, depending on the directional effects to be produced on the rigid shell of the boot.

3. A liner according to claim 2, wherein the liner upper enveloping the user's foot and malleoli is made of a comfort material that is easily adjusted to the morphology thereof, and wherein the top portion of the upper, having a composite structure, is extended above these parts.

4. A liner according to claim 1, wherein the comfort elements of the top portion of the liner upper have a generally elongated shape and are arranged side by side while being oriented in the vertical direction.

5. A liner according to claim 1, wherein the comfort elements are fixed behind the edges of the vertical opening that demarcate the thin envelope forming the collar, in the transverse direction at the top portion of the upper.

6. A liner according to claim 1, wherein the vertical opening for the foot entry is located in the anterior zone of the liner.

7. A liner according to claim 1, wherein the vertical opening for the foot entry is located in he posterior zone of the liner.

* * * * *